US011199322B2

(12) United States Patent
Rush, III et al.

(10) Patent No.: US 11,199,322 B2
(45) Date of Patent: Dec. 14, 2021

(54) FOAM METAL BURNER AND HEATING DEVICE INCORPORATING SAME

(71) Applicant: Solaronics, Inc., Auburn Hills, MI (US)

(72) Inventors: Richard Rush, III, Auburn Hills, MI (US); Thomas A. Martelle, Rochester Hills, MI (US)

(73) Assignee: Solaronics, Inc., Auburn Hills, MI (US)

( * ) Notice: Subject to any disclaimer, the term of this patent is extended or adjusted under 35 U.S.C. 154(b) by 144 days.

(21) Appl. No.: 16/356,015

(22) Filed: Mar. 18, 2019

(65) Prior Publication Data

US 2020/0300460 A1 Sep. 24, 2020

(51) Int. Cl.
*F23D 14/06* (2006.01)
*F23D 14/10* (2006.01)
*F23D 14/08* (2006.01)

(52) U.S. Cl.
CPC ..... *F23D 14/06* (2013.01); *F23D 14/08* (2013.01); *F23D 14/10* (2013.01)

(58) Field of Classification Search
CPC ..... F23D 14/16; F23D 2203/105
USPC ..... 431/354
See application file for complete search history.

(56) References Cited

U.S. PATENT DOCUMENTS 3,597,135 A * 8/1971 Kweller ..... F23D 14/04 431/148
4,257,757 A * 3/1981 Ashe ..... F23D 14/16 126/92 AC
5,186,620 A 2/1993 Hollingshead
5,511,974 A * 4/1996 Gordon ..... F23D 14/02 431/328
6,059,566 A * 5/2000 Cummings, III ..... F23D 14/02 239/434
6,364,657 B1 4/2002 O'Donnell
9,303,868 B2 * 4/2016 Smit ..... F23D 14/045
2015/0369495 A1 * 12/2015 Maricic ..... F24H 8/00 126/116 A
2019/0353346 A1 * 11/2019 Chen ..... B01F 15/00915

FOREIGN PATENT DOCUMENTS

DE 29605480 U1 * 7/1996 ..... A21B 2/00

OTHER PUBLICATIONS

"Manufacturing Routes for Metallic Foams" by John Banhart, JOM, 52 (12) (2000) pp. 22-27 (9 pages).

* cited by examiner

*Primary Examiner* — Steven B McAllister
*Assistant Examiner* — Aaron H Heyamoto
(74) *Attorney, Agent, or Firm* — Young Basile Hanlon & MacFarlane, P.C.

(57) ABSTRACT

A thimble shaped burner is made of a porous foam metal material and is adapted to be mounted on the interior of a plenum chamber receiving a fuel/air mixture under pressure. The fuel/air mixture infuses into the interior of the thimble shaped burner body and exits from it through a burner port in a support structure where the fuel/air mixture that has been infused through the burner body is ignited. The burners are typically used in multiples and are mounted by means conventional fasteners passing through reinforced mounting flanges on the interior of an air fuel plenum chamber. Flame lift off is reduced or eliminated by particular configurations and dimensions of annular metal washers that are used in association with the burner bodies for mounting purposes.

2 Claims, 5 Drawing Sheets

FIG. 3
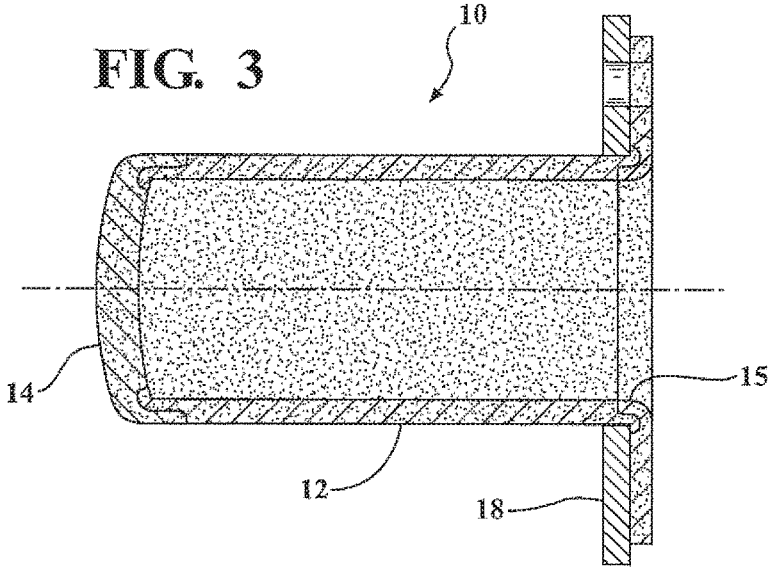
FIG. 4
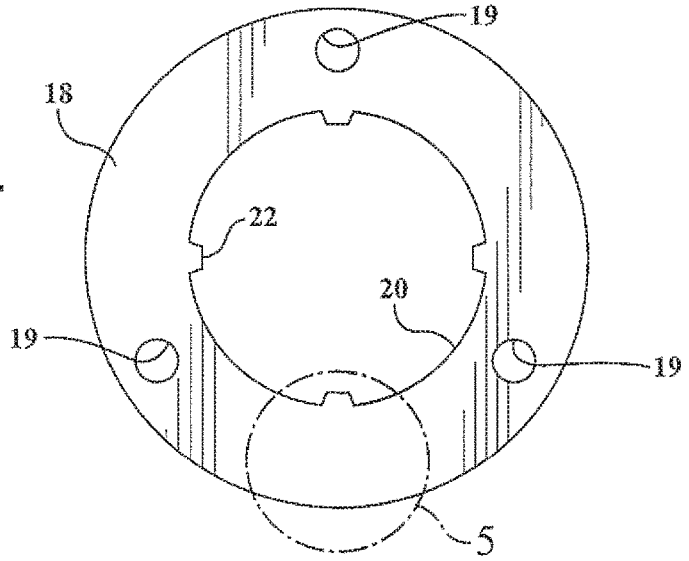
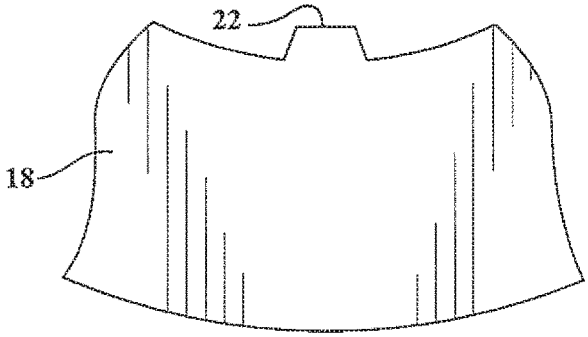
FIG. 5

FOAM METAL BURNER AND HEATING DEVICE INCORPORATING SAME

FIELD OF THE INVENTION

This invention lies in the field of burners and particularly to burners having bodies made of porous, air/fuel permeable foam metal material as well as to heating devices using multiples of said burners.

BACKGROUND OF THE INVENTION

Burners of various configurations and materials are used in many different applications from residential heating to the heating of food preparation devices such as deep fryers. The typical burner is made of non-porous ceramic or metal having separate fuel and air inlets both communicating with an outlet where the fuel/air mixture passing through the burner body is ignited. An example is shown in U.S. Pat. No. 6,364,657 issued Apr. 2, 2002.

BRIEF SUMMARY OF THE INVENTION

The present invention provides a burner made of a porous, air/fuel permeable, open-cell, foam metal material that allows an air/fuel premix to pass through the burner wall into the interior of the burner body. The body has a shape that facilitates mounting within a plenum chamber into which the air/fuel mixture is introduced.

In particular, the burner so constructed includes a hollow body, preferably of cylindrical configuration mounted inside of the plenum chamber such that a premixed, pressurized air/fuel mixture is infused into the interior of the burner body. The fuel/air mix then passes out of the burner body through an aperture at one end which is aligned with an aperture in a chamber wall where it can be ignited to produce a flame having little or no tendency to lift off of the surrounding structure.

In accordance with the invention the burner body is configured to have a closed end, and an integral annular flange adjacent the open end, which flange is used to fasten the burner body to the interior of the plenum chamber structure and, in particular, over an aperture in the plenum structure so that the fuel/air mixture infused into the porous body and through the open end passes through the aperture in the plenum structure where it is ignited. Screws are used to fasten the burner flange to the plenum wall and the flange is preferably reinforced in the areas of the screw holes to prevent damage to the foam metal when the screws are tightened.

The reinforcement can be an annular solid metal washer that overlies the foam metal flange. The metal washer is structured to have an interior diameter which is slightly greater than the outside diameter of the cylindrical foam metal body of the burner so as to create a gap which avoids reducing the surface area of the burner body and thereby prevents lowering the port velocity of the fuel/air mixture exiting the burner body. This reduces the possibility of flame lift off at the outlet.

Another aspect of the invention is a heater assembly comprising the combination of a plenum chamber structure such as a plate having plurality of apertures arranged serially or otherwise, and a plurality of burner bodies as described above mounted in the interior of the plenum chamber and over respective apertures. An air/fuel premix is introduced into the plenum chamber under pressure by conventional means such as a fuel/air mixing device including a pump.

The fuel/air mixture then infuses into the hollow interiors of the porous foam metal burner bodies by pressing through the walls and then travels along the interior of the burner bodies to the natural exits created by the open ends and then through the apertures in the plenum chamber structure to the exterior where ignition takes place.

In the event the burners are arranged linearly, tubular channels can be arranged between outer and inner burner flame front locations so only the outside burners require igniters. By way of example, in the case of four burners arranged linearly spaced relation, igniters are associated only with the outside burners, and the tubular channels are used to convey the flame fronts from outside ports to inside ports thereby to transfer the ignition of the fuel/air mixture from an outside burner port to an inside burner port.

BRIEF DESCRIPTION OF THE DRAWINGS

The inventions described herein will be best understood by a reading of the following specification which is to be taken with the accompanying drawings of which:

FIG. 3 is a side sectional view of the complete burner body as shown in FIG. 1;

FIG. 4 is a plan view in detail of the metal mounting flange;

FIG. 5 is a partial plan view of the metal mounting flange in an enlarged scale to show exemplary dimensions;

DETAILED DESCRIPTION OF THE ILLUSTRATIVE EMBODIMENTS

Figure 2:
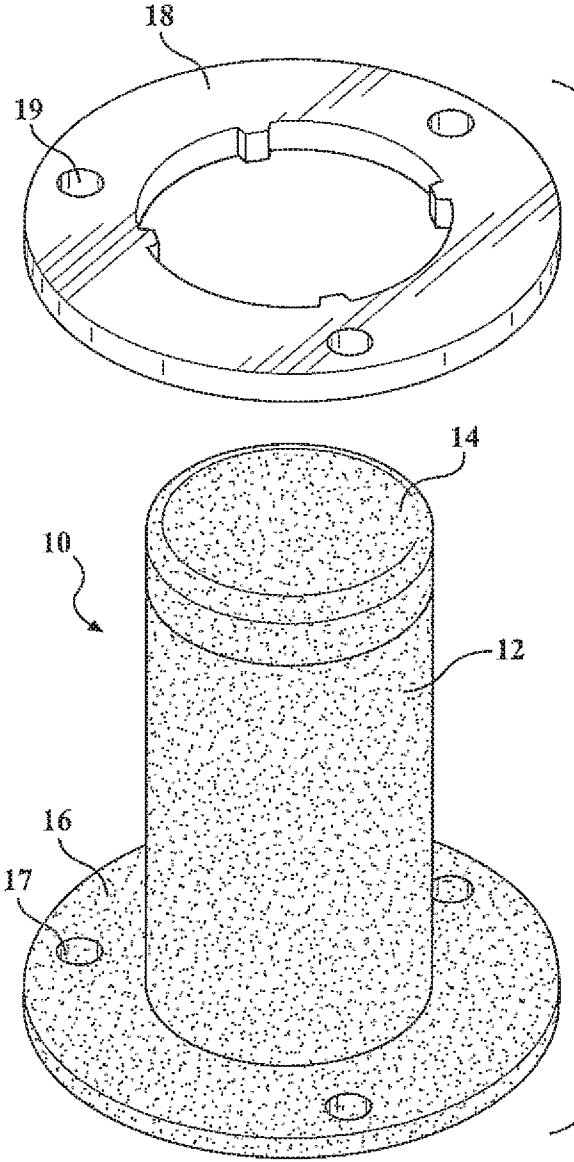
FIG. 2 is a further perspective view of the burner body with the metal mounting flange removed and shown separately.
Figure 1:
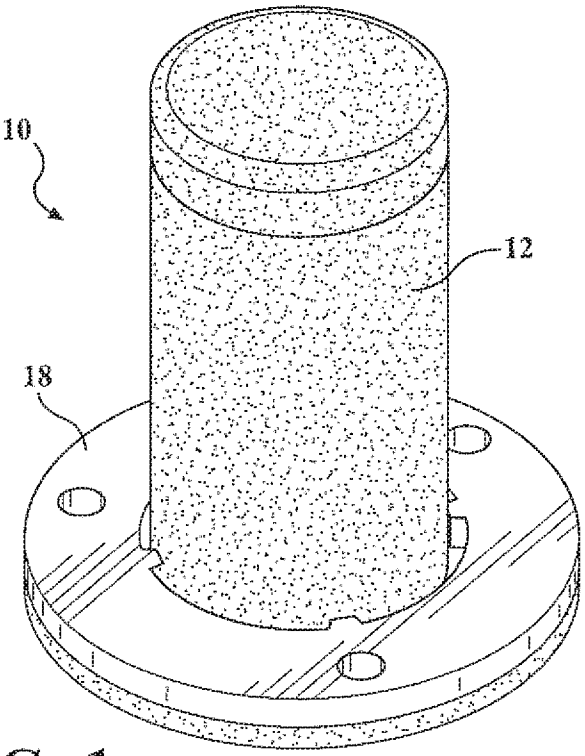
FIG. 1 is a perspective view of a burner body constructed in accordance with the present invention.

Referring now to FIGS. 1-5 there is shown a burner 10 having a thimble shaped body 12 with a hollow interior volume. The body 12 is closed at one axial end by a cap 14 and is open at the other end 15 as shown in FIG. 3. Surrounding the body 12 flush with the open end 15 is an integral foam metal flange 16 having three circumferentially spaced holes 17 formed therein for mounting purposes. The entire structure 12, 14 and 16 is formed of a porous, open-cell fuel/air permeable N30 foam metal such as aluminum. A pre-mix of fuel and air can infuse into the interior of the body 10 by passing under pressure through the wall of the burner 10 as hereinafter described. The pre-mix then flows to the natural exit provided by the open end 15.

An annular solid metal mounting washer 18 is dimensioned to fit over the thimble shaped cylindrical body 12 and lay flat against the top surface of the foam metal flange 16. The metal mounting flange 18 has holes 19 that register with the holes 17 in the foam metal mounting flange that is integral with the body 12 thereby to allow conventional metal fasteners to be inserted through the aligned holes and screwed into a support structure such as the bottom plate of a plenum structure hereinafter described. The annular washer represents just one way to reinforce the screw areas of the flange 16; e.g., smaller individual washers around the screw holes 19 can also be used.

As shown in the figures the interior diameter of the inner surface 20 of the metal mounting washer 18 is slightly greater than the outside diameter of the foam metal body 12 so as to create a radial gap between the inside edge of the metal washer 18 and the outside cylindrical surface of the foam metal body 12. This maximizes the exposed surface of the foam metal body and increases the area through which a fuel/air mixture under pressure can find ingress from the outside of the burner 10 to the interior thereof in use. Four equally circumferentially spaced tabs 22 on the interior edge 20 of the metal flange 18 are provided as shown in FIG. 4 to maintain the appropriate spacing during and after installation.

In the embodiment shown the external diameter of the body 12 is 0.787 inches plus or minus 0.015 inches while the radial dimension of the spacer tabs 22 is approximately 0.008 inches thereby to create the aforementioned gap. The overall axial length of the burner body 12 including the base flange 16 is 1.640 inches and the axial depth of the combination of the two flanges is approximately 0.140 inches. All dimensions given herein are exemplary in nature and are not to be construed in a limiting sense unless otherwise stated herein.

The material of the washer 18 is 304 stainless steel whereas the foam body is made of N30 foam metal. The thimble shaped burner is typically, but not necessarily, made in three parts: the body 12, the end cap 14 and the flange 16 and they are integrally joined by means of high temperature sintering.

Figure 6:
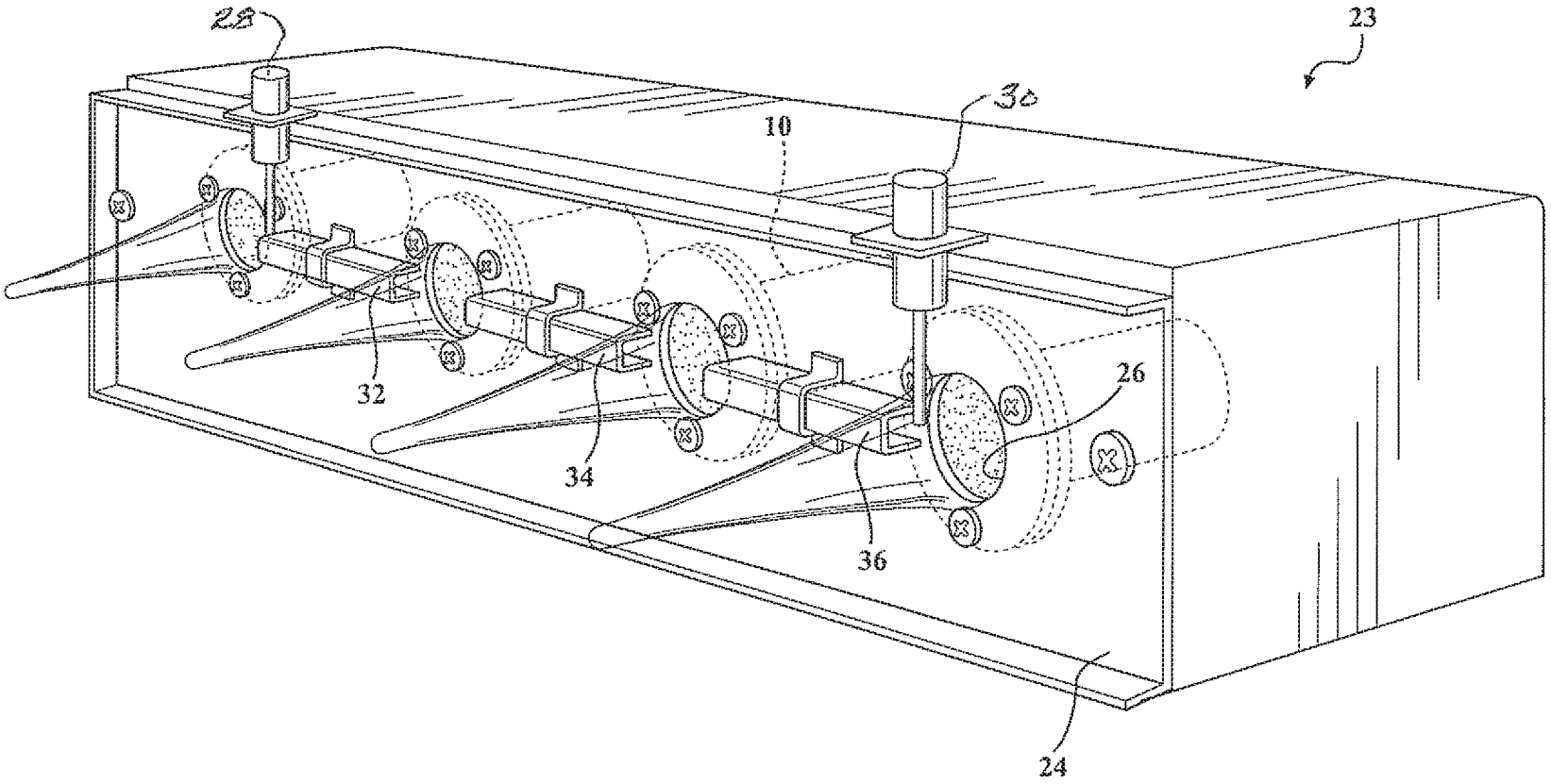
FIG. 6 is a perspective view of a heater using the burners of FIGS. 1-5.
Figure 7:
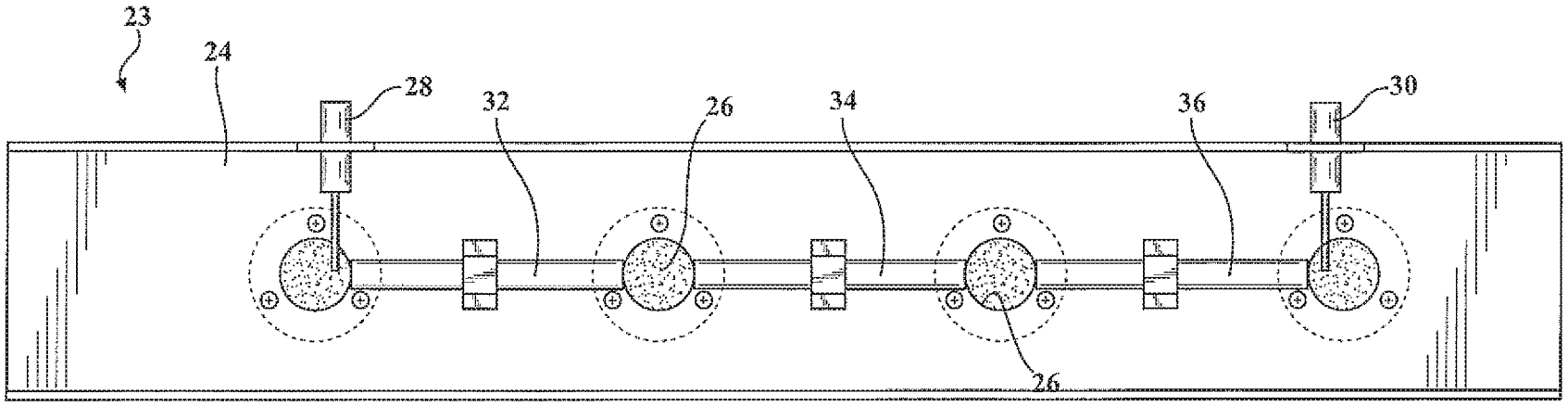
FIG. 7 is a bottom view of the heater of FIG. 6.
Figure 8:
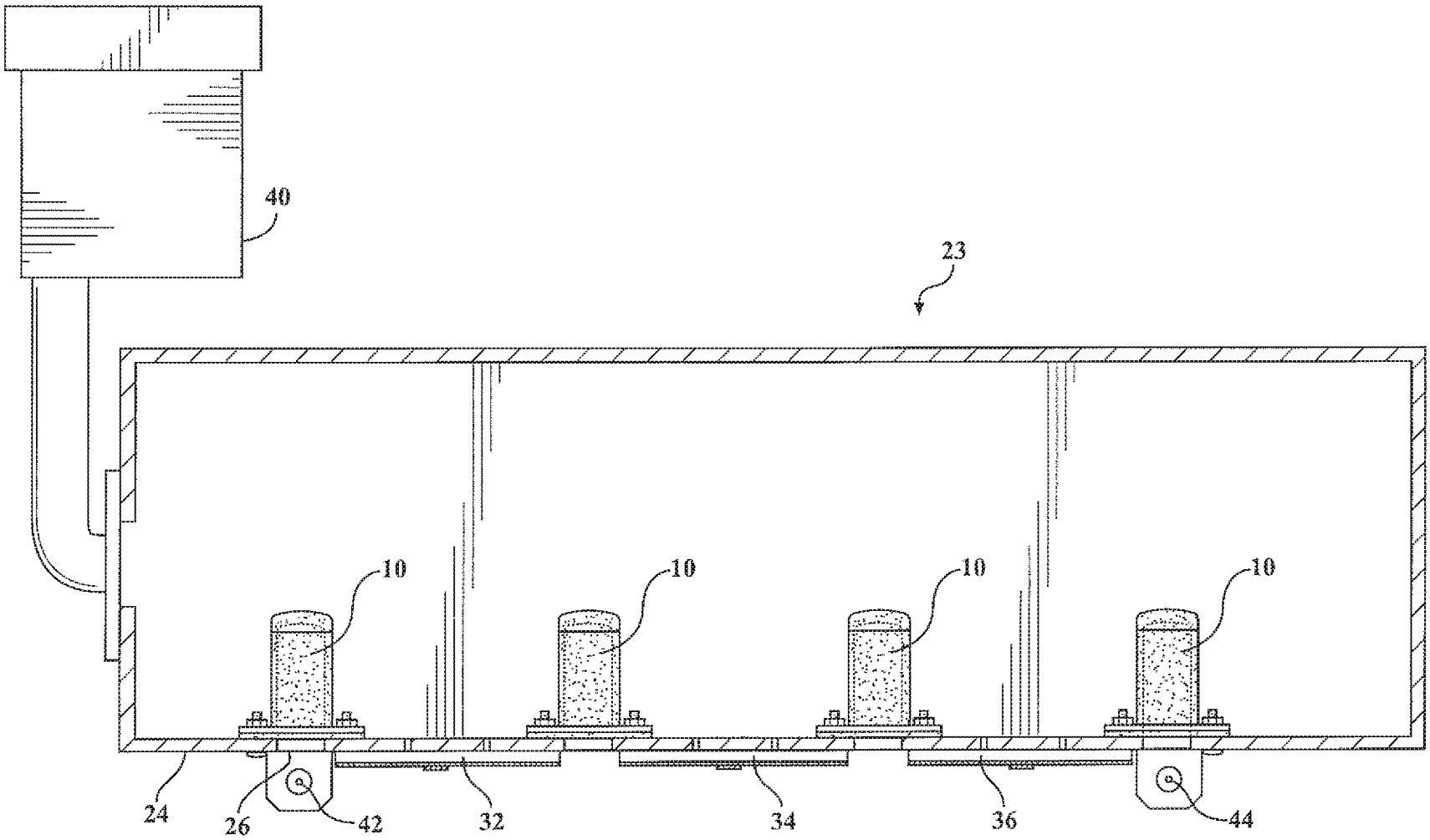
FIG. 8 is a side sectional view of the heater assembly shown in FIGS. 6 and 7, further showing the air/fuel premix charging devices.

Referring now to FIGS. 6, 7 and 8 the use of the burners hereinbefore described is shown. The structure 23 comprises a metal plenum having a base plate 24 through which a linearly arranged series of apertures 26 is made. As shown, four burners 10 are mounted by means of the aforementioned screws over the apertures and within the interior of the plenum structure 23 so that the cylindrical interiors of the burners are aligned with the apertures 26 in the plate 24. A fuel/air mixture is pumped under pressure to the plenum chamber 23 by means of a suitable and conventional device 40 such that all of the burners 10 receive the fuel/air mixture under pressure. Pressure causes mixture to infuse through the burner bodies and into the interior volumes thereof so as to exit through the open ends of the burner bodies and through the apertures 26 in the plenum plate 24. The showing of four linear-arranged burners is exemplary only as any number and arrangement of burners is possible.

As shown in FIGS. 6, 7, and 8, igniters 28 and 30 are shown associated with the burners serving the outermost flame ports or apertures 26 in the plate 24 so as to ignite the fuel/air mixture emanating from those burners. The ignition is transferred to the interior burners 10 by way of the tubes 32, 34, and 36 which run between the apertures. Ports are provided in the plate 24 to feed the fuel/air mixture from the plenum 23 into the tubes 32, 34, and 36. The end result is to ignite all four burners in the series using just two igniter devices.

The arrangement shown in FIGS. 6, 7 and 8 is explementary in nature and not to be construed in a limiting sense. It will be apparent to persons skilled in the art that while the invention has been described with respect to specific and illustrative embodiments thereof this description is not to be construed in a limiting sense as various changes, modifications and additions to the embodiments as described may be made by persons skilled in the art as well as various configuration changes to accommodate a particular need or desire of a given heating device. Information regarding the manufacture and composition of foam metal can be found in various technical articles including "Manufacturing Routes for Metallic Foams" by John Banhart, JOM, 52 (12) (2000) pp. 22-27.

What is claimed:

1. A heating device comprising:

a plenum having an interior wall with an aperture formed therein;

means for introducing a fuel/air mixture into said plenum;

a burner made of a fuel/air permeable foam metal and having a cylindrical body with a closed end and an open end, said body further having integral circular flange around the open end and having a top surface and a bottom surface, the body being mounted within said plenum with the open end in fluid communication with said aperture whereby the fuel/air mixture introduced into said plenum is infused into the burner through the body and exits the plenum through said aperture;

means for igniting the fuel/air mixture as it exits the plenum; and an annular metal mounting washer overlying the top surface of burner flange, said metal washer having an interior circular edge with an interior diameter greater than the exterior diameter of said burner body wherein said edge has a plurality of integral, radially inwardly directed spacers tabs to create a gap between said edge and said burner body.

2. A burner comprising;

A cylindrical body of porous, air/fuel permeable open-cell foam metal having a cylindrical sidewall defining a hollow interior;

said body being closed at one axial end and open at the other axial end;

a circular flange of permeable open-cell metal foam integral with the body flush with said open axial end and arranged peripherally there around; said flange having a top surface and bottom surface;

an annular metal mounting washer overlying the top surface of said burner flange, said metal washer having an interior circular edge with an interior r diameter great than the exterior of the diameter of said burner body wherein said edge has a plurality of integral, radial inwardly directed spacers tabs to create a gap between said edge and said burner body.

* * * * *